US005263831A

United States Patent [19]

Kappus

[11] Patent Number: 5,263,831

[45] Date of Patent: Nov. 23, 1993

[54] PERISTALTIC PUMP

[75] Inventor: John J. Kappus, Denver, Colo.

[73] Assignee: Cobe Laboratories, Inc., Lakewood, Colo.

[21] Appl. No.: 837,726

[22] Filed: Feb. 19, 1992

[51] Int. Cl.[5] ..... F04B 43/08

[52] U.S. Cl. ..... 417/477

[58] Field of Search ..... 417/474–477, 417/63

[56] References Cited

U.S. PATENT DOCUMENTS

| | | | |
|---|---|---|---|
| 2,693,766 | 11/1954 | Seyler | 103/149 |
| 2,885,996 | 5/1959 | Ford | 103/149 |
| 2,887,005 | 6/1961 | Dann | 417/477 |
| 2,909,125 | 10/1959 | Daniels | 103/149 |
| 3,822,948 | 7/1974 | Handl | 401/146 |
| 3,927,955 | 2/1975 | Spinosa | 417/477 |
| 4,108,575 | 8/1978 | Schal | 417/53 |
| 4,210,138 | 7/1980 | Jess | 417/477 |
| 4,363,609 | 12/1982 | Cosentino et al. | 417/477 |
| 4,487,558 | 12/1984 | Troutner | 417/477 |
| 4,548,553 | 10/1985 | Feaster | 417/477 |
| 4,558,996 | 12/1985 | Becker | 417/374 |
| 4,705,464 | 11/1987 | Arimond | 417/477 |
| 4,728,265 | 3/1988 | Cannon | 417/474 |
| 4,861,242 | 8/1989 | Finsterwald | 417/476 |
| 4,909,713 | 3/1990 | Finsterwald | 417/477 |
| 4,950,136 | 8/1990 | Haas et al. | 417/477 |

FOREIGN PATENT DOCUMENTS

| | | | |
|---|---|---|---|
| 3912310 | 9/1989 | Fed. Rep. of Germany | 417/477 |
| 544864 | 2/1956 | France | 417/477 |
| 1599090 | 7/1970 | France . | |

*Primary Examiner*—Richard A. Bertsch
*Assistant Examiner*—Peter Koryingy
*Attorney, Agent, or Firm*—Sheridan Ross & McIntosh

[57] ABSTRACT

A peristaltic pump for providing enhanced maintenance of a position of an interface between a substantially flexible tube and at least one roller which compressively engages such tube. In one embodiment, two rollers are incorporated on a rotor and are biased toward a raceway by a pivotal action to substantially totally occlude the tube between the rollers and the raceway. The biasing forces for each roller are provided by a pair of concentrically-positioned helical springs. Each of the springs, acting alone, is individually capable of generating sufficient biasing forces to substantially totally occlude the tube in one aspect of the invention. In another aspect, the force generating capabilities applied to these rollers are also monitored. In this regard, a visual indicator assembly is interconnected, for instance, with the above-identified springs. In the event of any reduction in the force applied to the roller by such springs, which may impair the roller's ability to engage the tube in the desired manner, a visual indication is provided of such a condition.

42 Claims, 5 Drawing Sheets

PERISTALTIC PUMP

FIELD OF THE INVENTION

The present invention generally relates to the field of peristaltic pumps and, more particularly, to peristaltic pumps which are used in extracorporeal blood treatment/analysis and specifically recognize the importance of maintaining a desired positional interface between a particular fluid flow line and a roller(s) which compressively engages such line.

BACKGROUND OF THE INVENTION

Numerous medical procedures involve the extracorporeal treatment/analysis of an individual's blood in which blood is removed from the individual, provided to an external apparatus which performs the desired treatment/analysis, and thereafter supplied back to the individual. Peristaltic pumps are commonly used in various aspects of these medical procedures not only to transfer the blood, but to introduce certain substances into the blood and/or to remove certain components harvested therefrom which are pertinent to the particular treatment/analysis as well.

Peristaltic pumps generally utilize a rotor having a plurality of spaced rollers which exert a force upon a flexible tube positioned between the rollers and an arcuate, stationary raceway (e.g., a cylindrical surface defining at least a portion of a cavity in which the rotor is positioned). This force is of a sufficient magnitude such that when the associated roller is aligned with the raceway, the tube is at least partially compressed, generally occluded. Consequently, as the rotor rotates the "column" of fluid between adjacently-located rollers is forced through the tube by the progressive compression of the tube about the raceway caused by such rollers.

Besides its primary pumping function, a peristaltic pump is often used for providing additionally either one or both of the following functions—a metering function for ensuring a given flow rate of liquid through the tube, and an occluding function for ensuring the interruption of the flow of liquid through the tube when the pump is stopped, in particular when it is pumping from a reservoir situated above the pump. A change in the positional interface of any of the pump's rollers relative to the tube will impair these three functions and, in particular, will affect the volume of fluid provided by the pump per revolution. For instance, if one of the rollers does not compress the tube as much after the desired positional interface is established, the volume of fluid provided by the pump will be reduced.

SUMMARY OF THE INVENTION

The peristaltic pump of the present invention is generally directed toward the maintenance of a desired positional interface between the flexible tube and at least one roller which is biased toward the raceway to compressively engage the tube. As used herein, the term "positional interface" in this sense means the position of the roller relative to the tube when engaged therewith as measured from a given reference point, line or plane, such as for instance the rotational axis of the rotor. In this regard, one aspect of the present invention provides enhanced capabilities for maintaining a positional interface between the tube and rollers at a location such that there is a desired degree of sealing of the tube (e.g., substantial total occlusion). Another aspect of the present invention provides a visual indication of a condition in which at least the potential for a change in the positional interface between the tube and the roller(s) has increased to the degree where subsequent pump performance in accordance with predefined parameters may be affected.

The present invention is generally an apparatus for pumping a fluid through a substantially flexible tube. In one embodiment the apparatus includes a pump casing which has an open cavity and an arcuate raceway which defines at least a portion of this cavity. A rotor is positioned within the cavity and rotatively drives at least two rollers which are each biased toward the raceway (i.e., the positioning of the rollers within the rotor is not fixed) by coacting first and second biasing members to engage the tube and achieve a desired degree of compression of the tube. In this regard, each roller preferably substantially totally occludes the tube against the raceway when radially aligned therewith. Advantageously, the coacting first and second biasing members each have sufficient force generating capabilities to separately provide for this desired degree of tube compression. The use of this dual biasing member configuration may not only reduce the wear of the individual biasing members, but also yields an arrangement whereby even if one of the biasing members experiences a reduction in force generating capabilities (e.g., in the case of any structural impairment), the other biasing member will serve to maintain the desired degree of tube compression.

The above-described embodiment may incorporate a number of additional features to enhance various aspects of the present invention. For instance, the two rollers may be mounted 180° apart on the rotor such that in the event the raceway extends at least 180° about the rotor, at least one of the rollers will always be positioned to engage the tube in the described manner. Moreover, the rollers may be pivotally incorporated within the rotor such that the first and second biasing members may be positioned to maximize their respective force generating capabilities and/or to reduce the effects of variances in the manufacture of such components and their positioning within the rotor. Furthermore, the second biasing member may be positioned interiorly of the first biasing member (e.g., concentrically) to not only provide a space savings feature, but to enhance the application of force to the tube by the rollers. In addition, a window or cavity within the rotor may be incorporated to allow for a visual inspection of each of the first and second biasing members when the rotor is removed. In the event that helical springs form the first and second biasing members with the second biasing member being positioned interiorly of the first biasing member as noted above to provide inner and outer springs, the coils of such springs may be wound in opposite directions, the pitch of the outer spring may be greater than the pitch of the inner spring, and the helix angle of the outer spring may be greater than that of the inner spring to further enhance the visual inspection of the first and second biasing members.

In another embodiment of the present invention, a peristaltic pump is provided which gives a visual indication of a condition which may present a potential problem with regard to the continued operation of the pump in a desired manner, namely based upon a change or an increased potential for a change in the positional interface between the tube and the roller(s). Generally, a pump casing has an open cavity which is defined at least in part by an arcuate raceway. A rotor is positioned within this cavity and incorporates at least one roller for engaging the tube against the raceway. In this regard, the roller is forced toward the raceway by a biasing member such that the roller compresses the tube to a desired degree (e.g., substantial total occlusion). In order to provide an operator with a visual indication that the force generating capabilities of the biasing member have been reduced to a level where continued pump operations may not be within a range of desired conditions, a visual indicator assembly is utilized. More particularly, the visual indicator assembly operatively interacts with the biasing member to detect a condition of the biasing member which may affect the desired positional interface between the roller and tube. Advantageously, this visual indicator assembly provides the desired visual indication even when the rotor is in an operational mode (i.e., positioned within the cavity of the pump casing).

The above-described embodiment may incorporate a number of additional features to enhance various aspects of the present invention. For instance, in one embodiment a portion of the visual indicator assembly physically engages the biasing member while another portion monitors the position of this particular interface and responds to a change of a predetermined degree to provide the desired visual indication. Consequently, the visual indicator assembly is mechanically responsive to changes in certain characteristics of the biasing member.

In one embodiment, the above-described interface between the visual indicator assembly and the biasing member is provided by a piston having a head with a stem attached thereto. The biasing member is seated on one face of the piston and extends to engage, directly or indirectly, the roller. One end of a reference spring is seated on the opposite face of the piston and its opposite end is seated within a stationary portion of the rotor. The biasing member and reference spring thus exert forces on the piston which are at least in part opposing to one another. A reference position or range of positions can thereby be established for the piston head which is associated with a biasing member having force generating capabilities within a desired range to maintain the desired degree of tube compression.

The stem of the piston completes the interconnection between the biasing member and the visual indicator assembly in the above-described embodiment. More particularly, the stem engages a notched portion of a visual indicator member to retain the visual indicator member in a first position. This visual indicator member is slidably positioned within the rotor and is biased by an indicator spring toward a second position, such as above an upper portion of the rotor so as to be observable under certain conditions. In this regard, upon a predetermined reduction in the force generating capabilities of the biasing member which is associated with at least an increased potential for an undesirable change in the positional interface between the tube and roller, the position of the described visual indicator assembly interface changes sufficiently to move the stem out of the notched portion of the visual indicator member. More particularly, when the reference spring exerts a greater opposing force upon the piston head than the biasing member to move the piston head outside of the predefined range, the position of the stem will move proportionally. As a result, the stem disengages the notched portion of the movable indicator member such that the indicator spring is able to extend and move the indicator member to its second position to provide the described visual indication.

Although the indicator member itself may provide the visual indication, it may also be used to provide alternate visual indications. For instance, instead of having the second position for the indicator member be above the upper surface of the rotor as in the referenced example, the second position may be at a location which is below the lower portion of the rotor. In this case, a hole may be incorporated on the floor of the cavity in which the rotor is inserted, the hole being at substantially the same radial position as the indicator member. Consequently, in the event that the stem disengages the notched portion of the indicator member in the above-described manner, when the indicator member becomes substantially vertically aligned with the hole, the indicator member will extend downwardly therein. This of course will terminate rotation of the rotor which would also be a visual indication of the monitored condition.

As can be appreciated, it would be advantageous to use the visual indicator assembly in combination with the configuration which incorporates first and second biasing members for each roller. In this case, the visual indicator assembly could provide the desired visual indication upon a loss of one of the first or second biasing members. After such loss, however, the tube would continue to be engaged in the desired manner by the remaining first or second biasing member. Consequently, the visual indication would be provided that an increased potential exists for a change in the positional interface between the tube and rollers, while such positional interface was still actually being maintained to achieve substantial total occlusion of the tube as a result of the force generating capabilities of the remaining first or second biasing member.

DETAILED DESCRIPTION

Figure 1:
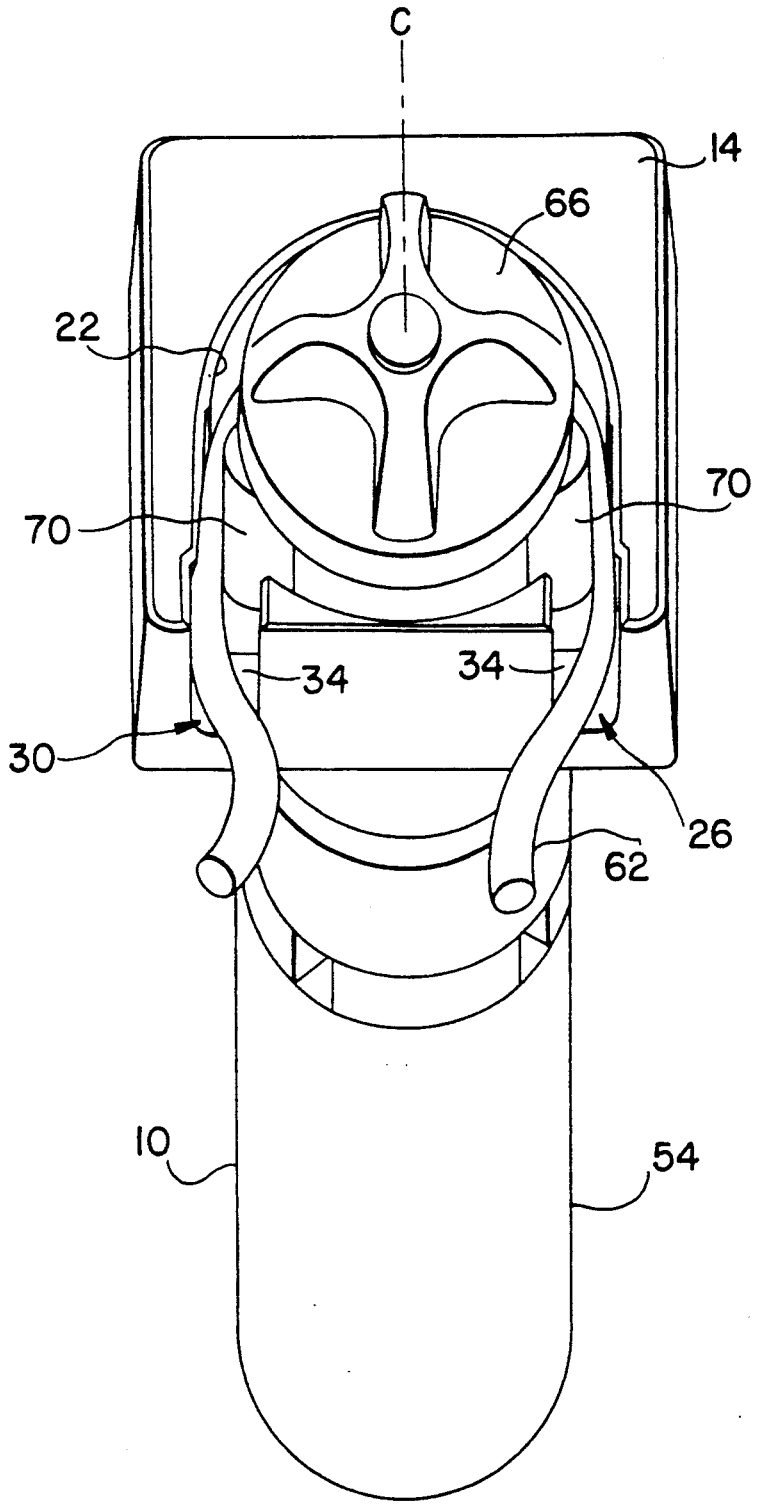
FIG. 1 is a perspective view of one embodiment of a peristaltic pump of the present invention.

The present invention will be described with reference to the attached drawings which assist in illustrating the pertinent features thereof. Generally, the present invention is a peristaltic pump which is directed toward the maintenance of a desired positional interface between a flexible tube and at least one of the pump's rollers which compressively engages the tube (e.g., to achieve substantial total occlusion of the tube). An embodiment which incorporates all aspects of the present invention is generally illustrated in FIG. 1.

The peristaltic pump 10 generally includes a stator 14 having an arcuate raceway 22 and a rotor 66 which is positioned within an open cavity 18 at a location which is inwardly from the raceway 22. Two freely rotatable rollers 70 are utilized by the rotor 66 for engaging a substantially flexible tube 62 against the raceway 22. As will be discussed in more detail below, the rollers 70 are preferably biased toward the raceway 22 with a force which is sufficient to substantially totally occlude the tube 62. Consequently, when the rotor 66 is rotated at a substantially constant speed by a motor 54 interconnected therewith, a controlled or closely metered volume, namely the "column" of fluid in the tube 62 between the rollers 70, is advanced through the tube 62 by the movement of the rollers 70 on the tube 62 (e.g., the progressive compression of the tube 62 along the raceway 22). Moreover, the substantial total occlusion of the tube 62 by the rollers 70 against the raceway 22 provides a seal within the tube 62 to substantially eliminate the flow of fluid through the tube 62 upon any termination of the operation of the pump 10 when a roller 70 is radially aligned with the raceway 22.

The stator 14 is a casing which houses the rotor 66 and a portion of the tube 62. In this regard, the stator 14 has an open cavity 18 in which the rotor 66 may be positioned as illustrated in FIGS. 1-2. The outer portion of this cavity 18 is defined in part by a raceway 22 which in one embodiment is semicircular, extending between points A and B in FIG. 2. An inlet 26 and an outlet 30 to the cavity 18 of the stator 14 are also provided. Consequently, the tube 62, one end of which is connected to an appropriate fluid source (not shown), passes through the inlet 26, around the raceway 22 and is biased thereagainst by the rollers 70 of the rotor 66, and through the outlet 30 for connection to the desired recipient of the fluid (not shown).

Figure 2:
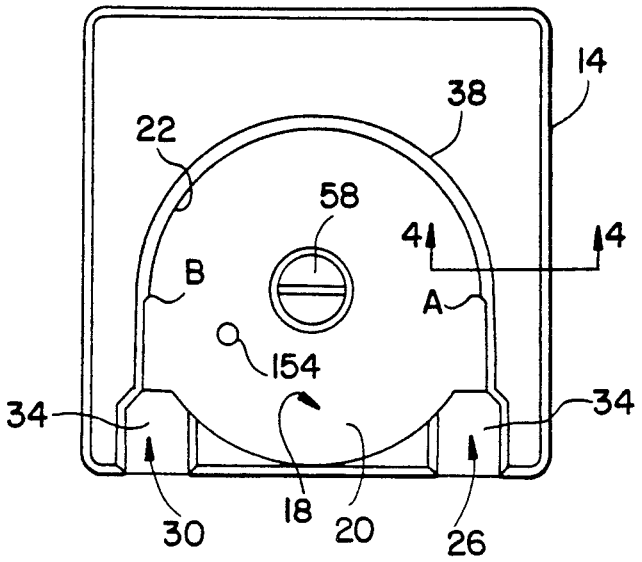
FIG. 2 is a top view of a stator with the rotor removed therefrom.
Figure 3:
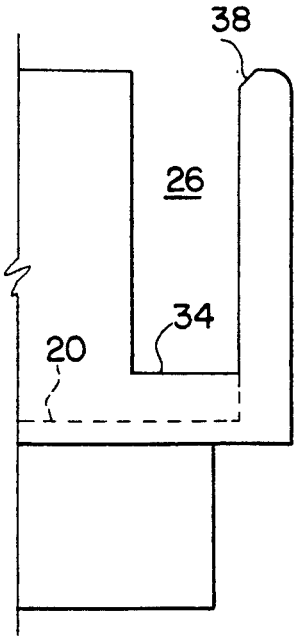
FIG. 3 is a partial front view of the stator of FIG. 2.
Figure 10:
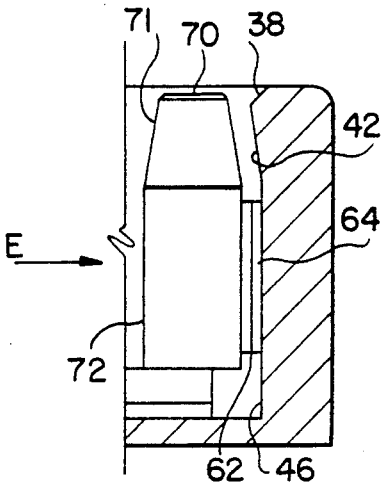
FIG. 10 is a partial side view of one of a roller substantially totally occluding the tube against the raceway.

In order to assist in maintaining the vertical positioning of the tube 62 on the raceway 22 such that the tube 62 is effectively aligned with the engaging portion 72 of the rollers 70 as will be discussed below in relation to FIG. 10, the inlet 26 and outlet 30 each include a base 34 for supporting the tube 62 at these respective locations as illustrated in FIGS. 1-3. Based upon this positioning of the tube 62 on the raceway 22, namely above the floor 20 of the cavity 18 (FIG. 3), the engaging portion 72 of the rollers 70 is able to fully engage the tube 62 as illustrated in FIG. 10 to achieve the preferred substantial total occlusion of the tube 62. As can be appreciated, effective engagement of the tube 62 by the rollers 70 to occlude the tube 62 may be affected if the tube 62 is positioned directly upon a supporting surface (i.e., if the tube 62 is positioned on the floor 20 of the cavity 18).

Figure 4:
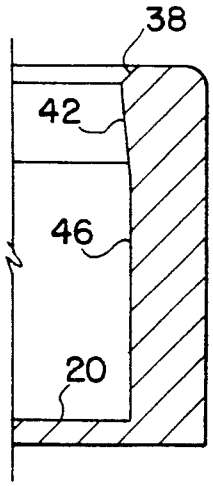
FIG. 4 is a cross-sectional view of the stator of FIG. 2 taken along line 4—4.

In order to facilitate the loading of the tube 62 between the rollers 70 and the raceway 22, an upper portion 38 of the stator 14 which is adjacent to the raceway 22 is beveled as illustrated in FIGS. 3-4. This also reduces the potential for this portion of the stator 14 causing any significant structural damage to the tube 62. The raceway 22 also incorporates features to accommodate the use of the tube 62. For instance, during rotation of the rotor 66, which is detachably connected in an appropriate manner to a shaft 58 of the motor 54 that extends upwardly within the cavity 18 (FIG. 2), there may be a tendency for the tube 62 to attempt to move out of the raceway 22 in a direction in which the cavity 18 opens (i.e., in the direction in which the cavity 18 projects). This type of movement may adversely affect the ability of the rollers 70 to engage the tube 62 in a desired manner (e.g., to achieve substantial total occlusion). Consequently, in one embodiment the raceway 22 includes first and second surfaces 42, 46 as illustrated in FIG. 4.

The first surface 42 of the raceway 22 is substantially frusto-conical and extends upwardly and inwardly toward the rotational axis C of the rotor 66 which coincides with the shaft 58 of the motor 54. The second surface 46 is substantially cylindrical and is positioned below the first surface 42 in a substantially parallel orientation relative to the rotational axis C of the rotor 66. In order to further enhance this aspect of the invention, the rollers 70 may be configured to effectively match the orientation of the raceway 22 by incorporating a tapered portion 71 which extends upwardly and inwardly toward the rotational axis of the rollers 70, coinciding with the roller pins 74, and an engaging portion 72 which is substantially parallel to the rotational axis of the rollers 70 as illustrated in FIG. 10.

The rotor 66 is positioned inwardly of the raceway 22 and is rotated by the motor 54 to advance a fluid through the tube 62 which is again positioned between the rollers 70 and the raceway 22. In this regard, the rotor 66 incorporates two freely rotatable rollers 70 which are biased outwardly toward the raceway 22 to engage the tube 62 as illustrated in FIG. 1. As can be appreciated, in certain medical procedures it is desirable to accurately control the volume of fluid which is provided to, for instance, an extracorporeal apparatus for treating/analyzing the blood. Consequently, the rollers 70 may be subjected to a degree of force so as to substantially totally occlude the tube 62 (FIG. 10) such that the peristaltic pump 10, when the rotor 66 is rotated at a substantially constant velocity, effectively provides such a constant volume, namely the "column" of fluid contained within the tube 62 between the two rollers 70. Advantageously, this substantial total occlusion of the tube 62 by the rollers 70 when subjected to such a biasing force also effectively seals the tube 62 such that in the event that operation of the pump 10 is terminated when a roller 70 is radially aligned with the raceway 22, the flow of fluid through the tube 62 is also substantially restricted. Therefore, the rollers 70 in this instance provide two functions.

Figure 5:
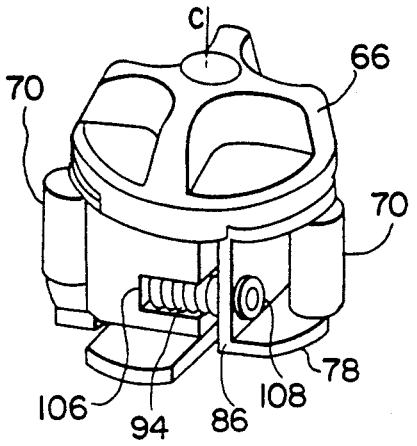
FIG. 5 is a perspective view of an embodiment of a rotor.
Figure 6:
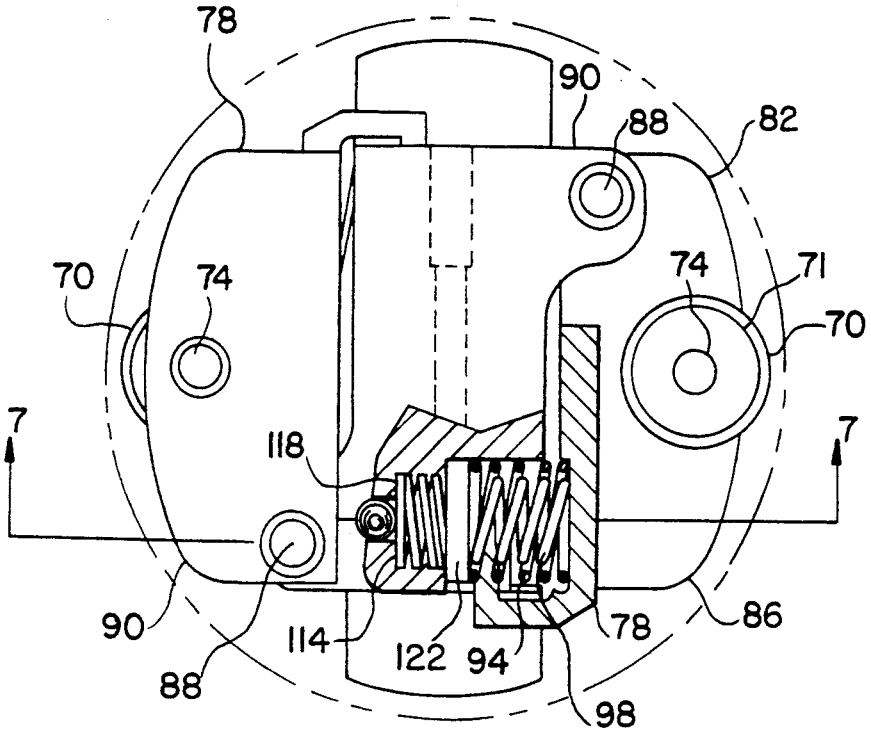
FIG. 6 is a partial cross-sectional view of an embodiment of a rotor.
Figure 7:
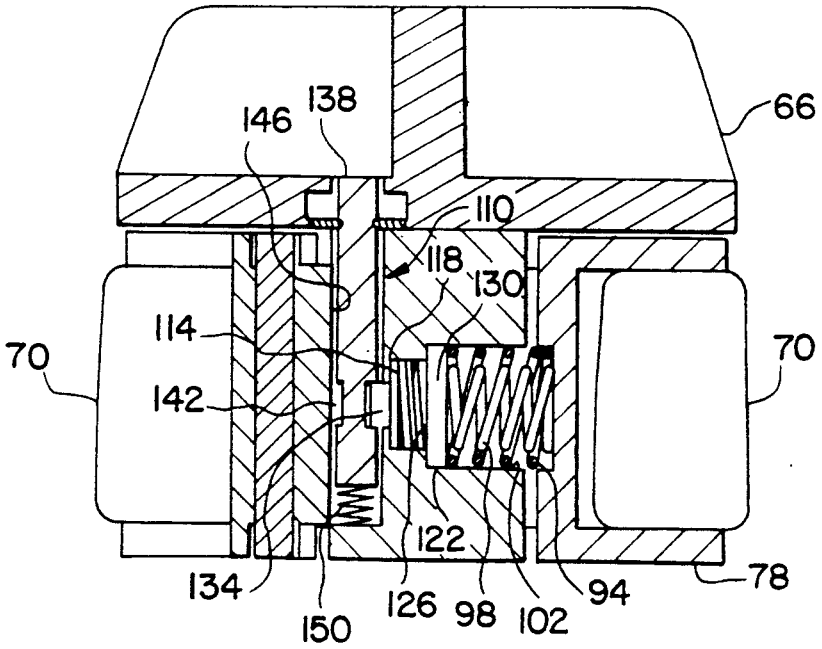
FIG. 7 is a cross-sectional view of the rotor of FIG. 6 taken along line 7—7.

The freely rotatable rollers 70 are biased outwardly toward the raceway 22 to engage the tube 62 in the above-described manner, preferably to achieve substantial total occlusion of the tube 62. More particularly, the rollers 70 are radially movable relative to the rotational axis C of the rotor 66. In one embodiment, this desired movement is effectively achieved by a pivotal mounting of the rollers 70. In this regard, each roller 70 is freely and rotatably mounted by a roller pin 74 to a pivot arm 78 at a position between first and second ends 82, 86 of the pivot arm 78 as illustrated in FIGS. 5-7. The first end 82 of each pivot arm 78 is pivotally connected to a supporting portion 90 of the rotor 66 by a pivot pin 88, while the second end 86 of each pivot arm 78 is engaged and forced outwardly away from the rotational axis C of the rotor 66 by first and second biasing members 94, 98 which are seated within the rotor 66 in a manner discussed below. As a result of the described manner of incorporating the rollers 70 with the rotor 66, the maximum moment arm is utilized which therefore maximizes the amount of the force applied to the tube 62 by the action of the first and second biasing members 94, 98 on the rollers 70. Moreover, the utilization of the maximum moment arm reduces the effects of variances in the manufacture of the first and second biasing members 94, 98, as well as variances in the positioning of the first and second biasing members 94, 98 in the rotor 66 (e.g., the distance between the pivot arm 78 and the location where the first and second biasing members 94, 98 are seated within the rotor 66).

As noted above, preferably the first and second biasing members 94 98 exert a force on each respective roller 70 to achieve substantial total occlusion of the tube 62 to enhance the metering capabilities of the pump 10 and to provide a desired sealing of the tube 62. A number of features may be incorporated to enhance this particular aspect of the present invention. Initially, since only two rollers 70 are utilized by the rotor 66, the rollers 70 may be mounted 180° apart to ensure that at least one of the rollers 70 can provide for a desired sealing of the tube 62 against the semicircular raceway 22, particularly upon termination of operation of the pump 10. Moreover, the present invention may utilize coacting first and second biasing members 94, 98 for each of the rollers 70 to provide enhanced capabilities for this sealing of the tube 62 by each of such rollers 70. Advantageously, the first or second biasing members 94, 98 for each roller 70 may be configured to individually generate sufficient forces to substantially totally occlude the tube 62 against the raceway 22 with the associated roller 70 (e.g., such that any failure of one of the first or second biasing members 94, 98 will not affect the positional interface between the roller 70 and the tube 62). The use of first and second biasing members 94, 98 for each roller 70 may also reduce the wear or fatigue of the first and second biasing members 94, 98.

Figure 8:
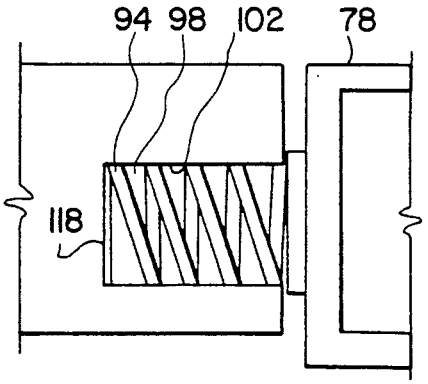
FIG. 8 is a side view of one embodiment of the first and second biasing members.

In one embodiment, the second biasing member 98 is positioned interiorly of its associated first biasing member 94 as illustrated in FIGS. 6–9. This relative positioning not only provides a savings of space within the rotor 66, but each pair of first and second biasing members 94, 98 also therefore exerts a coacting force on the same general area of the associated pivot arm 78, and thus the associated roller 70. In this regard, each pair of first and second biasing members 94, 98 are positioned within a biasing member cavity 102 and are seated against a portion of the visual indicator assembly 110 (discussed below) and a portion of the respective pivot arm 78. Advantageously, each of the first and second biasing members 94, 98, acting alone, may be configured to provide a sufficient biasing force to substantially totally occlude the tube 62 with the associated roller 70. Therefore, in the event that either one of the first or second biasing members 94, 98 discontinues to have the described force generating capabilities, this will not initially affect the ability of the associated roller 70 to substantially totally occlude the tube 62. As can be appreciated, this particular advantage can be achieved by configuring the first and second biasing member 94, 98 in a variety of configurations (e.g., having the rollers 70 slidably positioned in a block (not shown), having the first and second biasing members 94, 98 act upon different areas), or by utilizing alternative structures for providing the biasing forces. Moreover, the seating of the coacting first and second biasing members 94, 98 need not be against the visual indicator assembly 110 (discussed below) in this aspect of the present invention, but instead can be against a stationary portion of the rotor 70 such as the shoulder 118 discussed below and as illustrated in FIG. 8.

Figure 9:
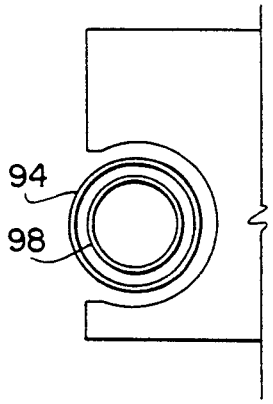
FIG. 9 is an end view of one embodiment of the first and second biasing members.

In one embodiment the first and second biasing members 94, 98 are helical springs. The springs comprising the first and second biasing members 94, 98 may be coiled in opposite directions as illustrated in FIG. 8 such that in the event of any structural impairment of one of the first or second biasing members 94, 98, the potential for such springs becoming interlaced, which may affect the biasing force generating capabilities of the first and second biasing members 94, 98, is reduced. Moreover, the springs comprising the first and second biasing members 94, 98 may be concentrically positioned as illustrated in FIG. 9 to further reduce the potential for the springs becoming interlaced. This concentric positioning is also advantageous to the first and second biasing members 94, 98 in general since it reduces the amount of torque applied to the pivot pins 88 of the two pivot arms 78 and since it directs the biasing force on the central portion of the tube 62 as will be discussed below.

In the event the first and second biasing members 94, 98 are helical springs, the diameters of the wires of the springs comprising the first and second biasing members 94, 98 may be different as also illustrated in FIG. 8. One problem encountered in springs in general is that a given material defect may be present in an entire roll of wire from which springs are formed. Consequently, by choosing springs having different wire diameters, which therefore come from different rolls of wire, the potential for the same material defect existing in each spring is significantly reduced. In order to accommodate for a greater variance in the manufacturing of the springs comprising the first and second biasing members 94, 98, as well as for variances in the distance between the pivot arm 78 and the opposite surface on which the first and second biasing members 94, 98, are seated, the spring constants for springs comprising the biasing members 94, 98 may also be maintained relatively low. For instance, in one embodiment the spring constants are about 18.75 pounds/inch for each spring of the first and second biasing members 94, 98.

The present invention also incorporates a number of features to assist in the inspection of the first and second biasing members 94, 98 when the rotor 66 is removed from the cavity 18 of the stator 14. In one embodiment, the first and second biasing members 94, 98 are positioned in an outer portion of the rotor 66 such that there is a window 106 to allow for a visual inspection of the first and second biasing members 94, 98 as illustrated in FIG. 5. As noted above, the first and second biasing members 94, 98 may be helical springs. When such springs are coiled in opposite directions as noted above, this also allows for enhanced visual inspection of the springs comprising the first and second biasing members 94, 98. Furthermore, the pitch of the springs comprising the first and second biasing members 94, 98 may also be varied. For instance, in one embodiment, the pitch of the spring comprising the first biasing member 94 is greater (i.e., there is a larger spacing between windings) than that of the spring comprising the second biasing member 98 which is positioned inside of the first biasing member 94 to enhance the visibility of the second biasing member 98. In this regard, it may be desirable for the first biasing spring 94 to be formed from a greater diameter wire than the second biasing spring 98. In addition, the spring comprising the first biasing member 94 may also have a greater helix angle than that of the spring comprising second biasing member 98 to provide a contrast which further enhances visibility.

Although the first and second biasing members 94, 98 have been described in detail herein with regard to performance capabilities, those skilled in the art will appreciate that the materials/performance criteria for such members 94, 98 may depend upon the characteristics of tube 62. As previously noted, the tube 62 is substantially flexible, such as PVC or silicone tubing, and thus material selection is a factor. Moreover, factors such as the inside and outside diameters of the tube 62 and its concentricity will dictate the amount of force generating capabilities required by the members 94, 98 to, for instance, substantially totally occlude the tube 62, as well as other factors such as the durometer rating of the tube 62. However, for purposes of illustration, in one embodiment the first and second biasing members 94, 98 exert a force of 12.4 pounds on the tube 62, which is more than double the amount required to produce substantial total occlusion of a given tube 62 plus a certain factor of safety.

In some instances, different diameters of flexible tube 62 will be used with the peristaltic pump 10. Moreover, there may be instances where it would otherwise be desirable to vary the distance between the rollers 70 and the raceway 22, and thus the positional interface between the rollers 70 and the tube 62. Consequently, one embodiment of the present invention includes a set screw 108 which controls the amount of outward radial movement of the rollers 70 provided by the first and second biasing members 94, 98 as illustrated in FIG. 5. By rotating the screw 108 in a first direction, the amount of outward radial movement of the pivot arm 78 will be reduced, whereas rotation of the set screw 108 in an opposite direction will allow further outward radial movement of the pivot arm 78, both of which may change the positional interface between the rollers 70 and the tube 62. It can be appreciated that the criteria of the first and second biasing members 94, 98, as well as the positioning of such, may be chosen to accommodate for the use of a large variety of tubes 62 such that a set screw 108 is not needed as illustrated in FIGS. 6–7.

In summarizing the normal operation of the peristaltic pump 10, the tube 62 is positioned between the rollers 70 and the raceway 22. As noted above, the tube 62 is positioned above the floor 20 of the cavity 18, as are the rollers 70 which are positioned on the pivot arm 78. As can be appreciated, the bottom portions of the pivot arms 78 should also not significantly engage the floor 20 since such contact would produce undesirable friction which may affect performance of the pump 10. When the motor 54 is activated, the rotor 66 begins to rotate, and the rollers 70 begin to travel around the raceway 22 to pump fluid through the tube 62, preferably by the progressive substantial total occlusion of the tube 62 by the rollers 70 about the raceway 22. In this regard, as a roller 70 approaches the raceway 22, it substantially totally occludes the tube 62 by forcibly engaging the opposing inner walls 64 of the tube 62. Advantageously, the first and second biasing members 94, 98 exert a force which coincides with a central axis of the tube 62 as noted by the arrow E in FIG. 10. As a result, the pump 10 provides a controlled volume of fluid, namely the column of fluid between the rollers 70, by the rotation of the rollers 70 and their progressive substantial total occlusion of the tube 62. As can be appreciated, this may be very critical in certain medical procedures. Moreover, upon any stoppage of the motor 54, one of the rollers 70 will still be substantially totally occluding the tube 62 against the raceway 22 to provide the desired sealing function of the present invention.

The present invention also monitors the forces applied to the rollers 70, and thus the positional interface between such rollers 70 and the tube 62. In this regard, this aspect of the present invention provides a visual indication of a condition in which the potential for a change in this positional interface has increased, or has in fact changed, to a degree where continued pump performance may not be within a predefined range of conditions or parameters. Advantageously, the visual indication is provided even when the rotor 66 is still positioned within the cavity 18 (e.g., when the rotor 66 is in an operational position within the stator 14).

Generally, a visual indicator assembly is interconnected with the given mechanism which is used to generate the biasing force used to move a roller toward the given tube to compress the tube to a desired degree. In this regard, in some instances the positional interface between the roller and the tube is established to achieve a certain result. Upon sensing a certain reduction in the force generating capabilities of the biasing mechanism used with the given roller, which could be associated with a change in the positional interface between the roller and the tube, an operator is provided with the desired visual indication that a potentially adverse condition exists.

One embodiment of the present invention which provides the desired visual indication is illustrated in FIGS. 6–7 and includes a visual indicator assembly 110 which is used for each roller 70 (only one shown). In this regard, a reference spring 114 is positioned against a shoulder 118 within the rotor 66 and engages a first face 126 of a piston 122, while the above-described first and second biasing members 94, 98 are seated on the second face 130 of the piston 122. The reference spring 114 thus exerts a force which is at least in part in opposition to the forces applied to the piston 122 by the first and second biasing members 94, 98. With further regard to the relationship between the reference spring 114 and the biasing members 94, 98, the force applied to the piston 122 by the reference spring 114 is less than the combined forces applied to the piston 122 by the first and second biasing members 94, 98. However, the force generating capabilities of the reference spring 114 exceeds the force generating capabilities of either one of the first or second biasing members 94, 98 acting alone. This relationship of the magnitudes of applied forces, namely a comparison between the biasing force applied to a roller 70 and a reference level, is used to provide the desired visual indication.

The shaft 134 of the piston 122 extends through the interior of the reference spring 114 and is seated within a notched portion 142 of a movable member 138. The shaft 134 is therefore interconnected with the interface between the reference spring 114 and the first and second biasing members 94, 98, namely the piston faces 126, 130. The movable member 138 is slidably positioned within an indicator cavity 146 of the rotor 66 in a directional orientation which is different than that of the biasing member cavity 102 which houses the first and second biasing members 94, 98. The movable member 138 is also biased, by an indicator spring 150 which exerts a force thereon, to provide one type of visual indication of a potentially adverse condition. More particularly, the indicator cavity 146 is aligned such that the movable member 138 will extend through an upper portion of the rotor 66 to provide the desired visual indication by the extension of the indicator spring 150 and subsequent upward extension of the movable member 138 at a given time.

During operations when a given pair of first and second biasing members 94, 98 are both functional, the associated reference spring 114 is incapable of generating sufficient forces to sufficiently compress the first and second biasing members 94, 98 to change the position of the interface and thus move the piston shaft 134 out of the notched portion 142. However, in the event the functionality of at least one of the two members 94, 98 is adversely affected to a certain degree (e.g., due to fatigue, breakage), the reference spring 114 will have sufficient force generating capabilities to compress the remaining first or second biasing member 94, 98 by moving the piston 122 towards the pivot arm 78. This movement of the interface also moves the shaft 134 out of the notched portion 142. Consequently, the indicator spring 150 is able to advance the movable member 138 upwardly to visually indicate that a condition exists (e.g., the existence of no back-up for one of the rollers 70 if based upon a failure of one of the first or second biasing members 94, 98) which may at some point in time present a sealing problem, such as a subsequent failure of the remaining first or second biasing members 94, 98, or of a condition in which sealing is an existing problem (e.g., the failure of both the first and second biasing members 94, 98).

Figure 11:
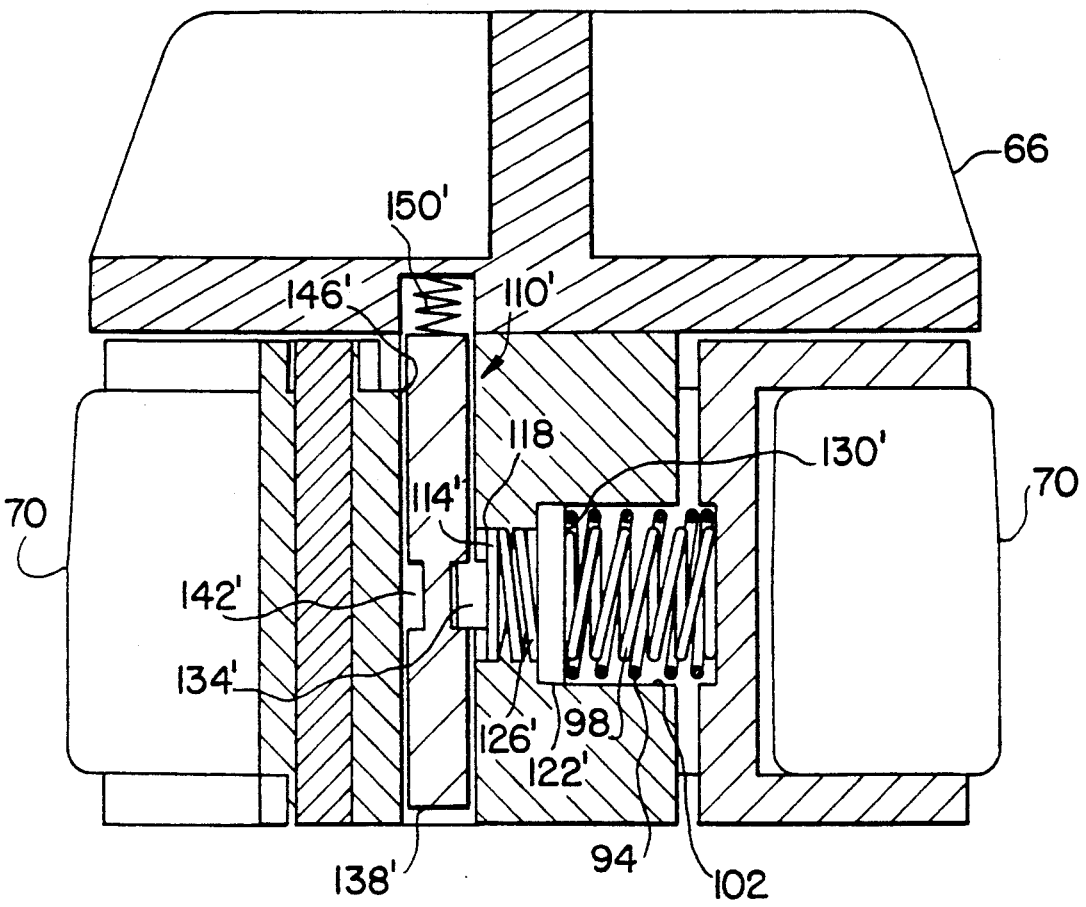
FIG. 11 is a cross-sectional view of an embodiment of a rotor.

As can be appreciated, the above-described visual indicator assembly 110 is not limited to providing a visual indication whereby the movable member 138 is actually extended above an upper portion of the rotor 66 such that it is visible to an operator. For instance, the visual indicator assembly 110' of FIG. 11 utilizes a configuration which provides another type of visual indication. In this regard, the indicator cavity 146' is closed on its upper portion such that it extends downwardly through the bottom portion of the rotor 66. The indicator spring 150' is thus positioned above the movable member 138' and a hole 154 (FIG. 2) is positioned on the floor 20 of the cavity 18 at the same general radial position as the movable member 138'. Therefore, when the shaft 134' becomes disengaged from the notched portion 142' in the above-described manner, the movable member 138' is driven downwardly by the indicator spring 150'. Once the rotor 66 is rotated so as to align the movable member 138' with the hole 154, the indicator spring 150' further extends such that the movable member 138' projects down within the hole 154. This, of course, stops the rotation of the rotor 66 to provide the desired visual indication. Advantageously, the hole 154 can be positioned such that when the rotor 66 is stopped in the described manner, a remaining functional roller 70 will be aligned with the raceway 22. Therefore, if the positional interface between such roller 70 and the tube 62 is established to produce a substantial total occlusion of the tube 62, the roller 70 will provide the described sealing function.

Although the aspects of the present invention which incorporate the visual indicator assembly 110/110' have been described in combination with the first and second biasing members 94, 98, those skilled in the art will appreciate that the visual indicator assembly 110/110' may be utilized with an alternate device(s) which supplies biasing forces to a roller in a pump of the type described herein, such as those which utilize a single spring or comparable mechanism to provide the desired biasing force, and/or may be utilized with alternate configurations for applying this biasing force to a given roller (e.g., pivotal or slide configurations). Moreover, the visual indicator assembly 110/110' also need not be used with the first and second biasing members 94, 98 to detect a failure of any one of such biasing members 94, 98, but may instead be used to detect a loss in the overall force generating capabilities of the first and second biasing members 94, 98 due, for instance, to fatigue. Furthermore, the visual indicator assembly 110/110' can be utilized simply to detect a certain reduction in the amount of biasing forces applied to a given roller, regardless of whether such roller is used to substantially totally occlude the tube (e.g., in some cases, the positional interface between the tube and given roller is established to provide a desired output such that it would be desirable to note a change in the position by incorporating the visual indicator assembly 110/110'). In addition, in the event that a given rotor only utilizes only a single roller, it still may be desirable to also incorporate the visual indicator assembly 110/110' of the type described herein.

Based upon the foregoing, it can be appreciated that the above-described peristaltic pump 10 is directed toward the maintenance of a certain interaction between the tube and at least one roller, and thus encompasses both of the above-identified aspects. For instance, the first and second biasing members 94, 98 may each possess the force generating capabilities required to substantially totally occlude the tube 62 (e.g., a positional interface in which the roller 70 causes the engagement of the inner walls 64 of the tube 62). Consequently, this structural portion of the pump 10 in and of itself provides enhanced capabilities for maintaining substantial total occlusion of the tube 62 or a certain positional interface. The above-described visual indicator assembly 110/110', on the other hand, interacts with the member(s) which provide the biasing force to the rollers 70 to monitor its performance. More particularly, the visual indicator assembly 110/110' provides a visual indication of a condition coinciding with a change or an increased potential for a change in the position of the roller relative to the tube or the positional interface therebetween (e.g., a change in the degree of compression which may affect pump performance). For instance, in the event a single biasing member is utilized, the visual indicator assembly 110/110' will provide an indication that the described condition actually exists. In the event that the described first and second biasing members 94, 98 are utilized to achieve substantial total occlusion of the tube 62, the visual indicator assembly 110/110' may be activated when the mere potential for a change in the positional interface exists (e.g., when one of the first or second biasing members 94, 98 fails). As can be appreciated, these two aspects of the present invention, namely utilizing two coacting biasing members which are each able to provide for substantial total occlusion of a tube and utilizing a visual indicator assembly to monitor the performance of a biasing member(s) to detect a change in the manner in which the associated roller interacts with the tube, may be employed individually or in combination.

The foregoing description of the present invention has been presented for purposes of illustration and description. Further, the description is not intended to limit the invention to the form disclosed herein. Consequently, variations and modifications commensurate with the above-identified teachings, and the skill or knowledge of the relevant art, are within the scope of the present invention. The embodiments described hereinabove are further intended to explain best modes known of practicing the invention and to enable others skilled in the art to utilize the invention in such, or other, embodiments and with the various modifications required by the particular applications or uses of the invention. It is intended that the appended claims be construed to include alternative embodiments to the extent permitted by the prior art.

What is claimed is:

1. An apparatus for pumping a fluid through a substantially flexible tube, comprising:

a casing having an open cavity and an arcuate raceway defining at least a portion of said cavity, the tube being positionable against said raceway;

a rotor positioned within said cavity, said rotor comprising at least two roller means for engaging the tube against said raceway and first and second biasing means associated with each of said at least two roller means for forcing said associated roller means toward said raceway, said first and second biasing means comprising first and second helical springs, respectively, said second helical spring being positioned interiorly of said first helical spring, wherein said first and second biasing means are coacting and each is capable of providing sufficient forces to substantially totally occlude the tube; and drive means for rotating said rotor.

2. An apparatus, as claimed in claim 1, wherein:

said raceway comprises first and second raceway surfaces, said first raceway surface being substantially parallel to a rotational axis of said rotor, said second raceway surface being positioned above said first raceway surface in a first direction in which said cavity projects, wherein said first and second raceway surfaces intersect.

3. An apparatus, as claimed in claim 2, wherein:

a reference plane extending from said second raceway surface in said first direction intersects said rotational axis of said rotor, whereby said second raceway surface assists in forcing the tube toward said first raceway surface.

4. An apparatus, as claimed in claim 1, wherein:

said at least two roller means are each rotatably incorporated on said rotor.

5. An apparatus, as claimed in claim 1, wherein:

said at least two roller means are mounted 180 degrees apart on said rotor and said raceway extends at least 180 degrees about said rotor.

6. An apparatus, as claimed in claim 1, wherein:

said at least two roller means are each rotatably connected to a first portion of said rotor, each said first portion being pivotally connected to a second portion of said rotor.

7. An apparatus, as claimed in claim 6, wherein:

each of said at least two roller means is positioned between a pivotal end and a distal end of said first portion where said first and second biasing means exert a force on said first portion.

8. An apparatus, as claimed in claim 1, wherein:

a rotational axis of each of said at least two roller means is substantially parallel to a rotational axis of said rotor.

9. An apparatus, as claimed in claim 1, wherein:

said at least two roller means each have first and second roller body surfaces, said first roller body surface being substantially parallel to a rotational axis of said at least two roller means, said second roller body surface being positioned above said first roller body surface in a first direction in which said cavity projects, wherein said first and second roller body surfaces intersect.

10. An apparatus, as claimed in claim 9, wherein:

a reference plane extending from said second roller body surface of said at least two roller means in said first direction intersects said rotational axis of said roller means.

11. An apparatus, as claimed in claim 10, wherein:

said raceway comprises first and second raceway surfaces, said first raceway surface being substantially parallel to a rotational axis of said rotor, said second raceway surface being positioned above said first raceway surface in said first direction, said first and second raceway surfaces intersecting, wherein a plane extending from said second raceway surface in said first direction intersects a rotational axis of said rotor.

12. An apparatus, as claimed in claim 1, wherein:

said second biasing means is positioned interiorly of said first biasing means.

13. An apparatus, as claimed in claim 1, wherein:

said first and said biasing means are concentric.

14. An apparatus, as claimed in claim 1, wherein:

said first and second helical springs are oppositely coiled.

15. An apparatus, as claimed in claim 1, wherein:

said first and second helical springs are concentric.

16. An apparatus, as claimed in claim 1, wherein:

a pitch of said first helical spring exceeds a pitch of said second helical spring.

17. An apparatus, as claimed in claim 1, wherein:

a helix angle of said first helical spring exceeds a helix angle of said second helical spring.

18. An apparatus, as claimed in claim 1, further comprising:

window means for allowing visible inspection of said first and second biasing means.

19. An apparatus, as claimed in claim 1, wherein:

a diameter of a wire forming said first helical spring is greater than a diameter of a wire forming said second helical spring.

20. An apparatus, as claimed in claim 1, wherein:

a spring constant of said first helical spring is substantially equal to a spring constant of said second helical spring.

21. An apparatus, as claimed in claim 1, further comprising:

means for limiting the amount of movement of said at least two roller means toward said raceway.

22. An apparatus, as claimed in claim 21, wherein:

said means for limiting is adjustable.

23. An apparatus, as claimed in claim 1, wherein:

said first and second biasing means are substantially coaxial and exert a force on said associated roller means which is substantially aligned with a central portion of the tube when positioned against said raceway.

24. An apparatus, as claimed in claim 1, further comprising:

visual indicator means, interconnected with said first and second biasing means for each said at least two roller means, for providing a visual indication of a failure of at least one of said first and second biasing means.

25. An apparatus for pumping a fluid through a substantially flexible tube, comprising:

a casing having an open cavity and an arcuate raceway defining at least a portion of said cavity, wherein the tube is positionable against said raceway;

a rotor positioned within said cavity, said rotor comprising at least one roller means for engaging the tube against said raceway and a biasing means for forcing said roller means toward said raceway to compressively engage the tube, said biasing means being substantially contained within said rotor; and a visual indicator assembly operatively interfaced with said biasing means, wherein said visual indicator assembly provides a visual indication of a first condition, said first condition being at least a certain reduction in the amount of force applied to said at least one roller means by said biasing means.

26. An apparatus, as claimed in claim 25, wherein:

said biasing means comprises a first biasing member and a second biasing member positioned interiorly of said first biasing member, said first and second biasing members both exerting a coacting force on said roller means to move said roller means toward said raceway.

27. An apparatus, as claimed in claim 26, wherein:

said visual indicator assembly provides a visual indication of a failure of at least one of said first and second biasing members.

28. An apparatus, as claimed in claim 25, wherein:

said visual indicator assembly comprises a first member interconnected with said rotor and movable between a first position and a second position, means for retaining said first member in said first position during a condition other than said first condition, and means for moving said first member to said second position upon said first condition.

29. An apparatus, as claimed in claim 28, wherein:

said means for retaining comprises pin means for engaging a notched portion of said first member.

30. An apparatus, as claimed in claim 28, wherein:

said means for retaining comprises first spring means engagable with said biasing means, said first spring means and said biasing means exerting a force along a first direction.

31. An apparatus, as claimed in claim 30, wherein:

said first spring means engages said pin means and moves said pin means away from said notched portion during said first condition.

32. An apparatus, as claimed in claim 28, wherein:

said means for moving comprises second spring means.

33. An apparatus, as claimed in claim 28, wherein:

said means for moving exerts a force on said first member in a direction which is different from a direction of the force applied to said roller means by said biasing means.

34. An apparatus, as claimed in claim 25, wherein:

said visual indicator assembly comprises:

first spring means for engaging and exerting a force upon said biasing means;

a first member slidably positioned in said rotor and having a notched portion;

pin means for engaging said notched portion, wherein said pin means is interconnected to an interface between said first spring means and said biasing means;

second spring means for exerting a force on said first member, wherein said first condition changes a position of said interface to move said pin means out of said notched portion, said second spring means thereby moving said first member to provide said visual indication of said first condition.

35. An apparatus for pumping a fluid through a flexible tube, comprising:

a casing having an arcuate raceway for receiving at least a portion of the tube;

a rotor positioned interiorly of said raceway and comprising first and second roller means for engaging the tube against said raceway and first and second biasing assemblies for forcing said first and second roller means, respectively, toward said raceway, said first and second biasing assemblies each comprising first and second concentrically positioned biasing members with said second biasing member being positioned interiorly of said first biasing member and each being capable of substantially totally occluding the tube;

drive means for rotating said rotor; and first and second sensor assemblies interconnected with said first and second biasing assemblies, respectively, wherein said first and second sensor assemblies sense a failure of at least one of said first and second biasing members of said first and second biasing assemblies, respectively.

36. An apparatus for pumping a fluid through a substantially flexible tube, comprising:

a casing having an open cavity and an arcuate raceway defining at least a portion of said cavity, wherein the tube is positionable against said raceway;

a rotor positioned within said cavity, said rotor comprising at least one roller means for engaging the tube against said raceway and a biasing means for forcing said at least one roller means toward said raceway to compressively engage the tube; and visual indicator means, interconnected with said biasing means, for providing a visual indication of a first condition, said first condition being at least a certain reduction in the amount of force applied to said roller means by said biasing means, wherein said visual indicator means comprises:

a first member interconnected with said rotor and movable between a first position and a second position;

means for retaining said first member in said first position during a condition other than said first condition; and means for moving said first member to said second position upon said first condition.

37. An apparatus, as claimed in claim 36, wherein:

said means for retaining comprises pin means for engaging a notched portion of said first member.

38. An apparatus, as claimed in claim 36, wherein:

said means for retaining comprises first spring means engagable with said biasing means, said first spring means and said biasing means exerting a force along a first direction.

39. An apparatus, as claimed in claim 38, wherein:

said first spring means engages said pin means and moves said pin means away from said notched portion during said first condition.

40. An apparatus, as claimed in claim 36, wherein:
said means for moving comprises second spring means.

41. An apparatus, as claimed in claim 36, wherein:
said means for moving exerts a force on said first member in a direction which is different from a direction of the force applied to said roller means by said biasing means.

42. An apparatus for pumping a fluid through a substantially flexible tube, comprising:

a casing having an open cavity and an arcuate raceway defining at least a portion of said cavity, wherein the tube is positionable against said raceway;

a rotor positioned within said cavity, said rotor comprising at least one roller means for engaging the tube against said raceway and a biasing means for forcing said roller means toward said raceway to compressively engage the tube; and visual indicator means, interconnected with said biasing means for providing a visual indication of a first condition, said first condition being at least a certain reduction in the amount of force applied to said at least one roller means by said biasing means, said visual indicator means comprising:

first spring means for engaging and exerting a force upon said biasing means;

a first member slidably positioned in said rotor and having a notched portion;

pin means for engaging said notched portion, wherein said pin means is interconnected to an interface between said first spring means and said biasing means;

second spring means for exerting a force on said first member, wherein said first condition changes a position of said interface to move said pin means out of said notched portion, said second spring means thereby moving said first member to provide said visual indication of said first condition.

* * * * *